US007337917B2

(12) United States Patent
Kortleven

(10) Patent No.: US 7,337,917 B2
(45) Date of Patent: Mar. 4, 2008

(54) INTERLOCKABLE SEAL

(75) Inventor: Hanno Kortleven, Rotselaar (BE)

(73) Assignee: Dart Industries Inc., Orlando, FL (US)

( * ) Notice: Subject to any disclaimer, the term of this patent is extended or adjusted under 35 U.S.C. 154(b) by 347 days.

(21) Appl. No.: 10/875,501

(22) Filed: Jun. 25, 2004

(65) Prior Publication Data

US 2006/0006187 A1 Jan. 12, 2006

(51) Int. Cl.
*B65D 41/18* (2006.01)
*B65D 43/03* (2006.01)

(52) U.S. Cl. ..... 220/793; 220/380; 220/780

(58) Field of Classification Search ..... 220/4.26, 220/380, 793, 790; 206/503, 507, 509, 515
See application file for complete search history.

(56) References Cited

U.S. PATENT DOCUMENTS 1,908,806 A 5/1933 Allen
2,695,115 A 11/1954 Roop
3,145,870 A * 8/1964 Lockwood ..... 220/4.24
3,180,537 A 4/1965 Collins
3,342,397 A * 9/1967 Duitsman ..... 229/406
3,360,153 A 12/1967 Wheaton
3,419,176 A 12/1968 Lipfert et al.
3,616,943 A * 11/1971 Brink ..... 206/508
3,749,278 A 7/1973 Von Boch-Galhau
4,081,101 A 3/1978 West
4,324,097 A 4/1982 Schmitt et al.
4,807,776 A 2/1989 Cortopassi
4,906,806 A 3/1990 Levinson
4,978,022 A 12/1990 Weick
5,409,126 A 4/1995 DeMars
5,605,231 A * 2/1997 Borsboom et al. ..... 206/551
5,799,792 A 9/1998 Abrums
5,964,350 A 10/1999 LaMarche et al.
6,886,704 B2 * 5/2005 Hayes et al. ..... 220/4.24

* cited by examiner

*Primary Examiner*—Robin A. Hylton

(57) ABSTRACT

A seal for a container, the seal having a base panel with multiple upwardly projecting protuberances on the base panel spaced so as to define recesses complementary to the protuberances for reception of the protuberances within the recesses of a duplicate inverted seal and for selective interlocking engagement of the seals to each other.

17 Claims, 4 Drawing Sheets

INTERLOCKABLE SEAL

BACKGROUND OF THE INVENTION

The present invention is broadly concerned with the provision of means which allow for the stacking of containers. More particularly, the invention relates to imperforate containers seals which accommodate and facilitate the stacking of containers through interaction between the seals themselves.

While it is generally known to provide for the stacking of containers wherein the bottom of the container is particularly configured for accommodation within or on an underlying seal, such an arrangement, in order to provide for the desired stacking, specifically requires the complementary configuration of the container bottom with the seal if the desired stacking effect is to be achieved.

As conventional seal-closed food bowls and the like, and the seals for such bowls, are frequently used interchangeably, requiring only that the seal correspond to the mouth of the container, the requirement that the seal and bowl base both be specifically configured to achieve stackability, does not readily adapt itself to the interchangeability between seals and containers normally desired in actual use.

Another form of stacked containers is illustrated in U.S. Pat. No. 5,871,116, issued to Romana Picchietti on Feb. 16, 1999. The stacked containers in this patent are positioned with the upper container inverted relative to the lower container and joined by a perforated disc which specifically engages both seals and provides for communication between the interior of the two containers. While this patent, in FIG. 5A does disclose an imperforate panel for sealing an individual container, the stacking of the containers requires a removal of this imperforate seal and the use of the separate perforated joining disc. No provision is made for the utilization of the individual container seals as a stacking means.

SUMMARY OF THE INVENTION

A principal object of the present invention is to provide a distinct imperforate container seal which is uniquely adapted to releasably snap-lock to a duplicate seal secured to a container inverted relative to the first container. It is contemplated that the seal of the invention mount releasably to a conventional food container or the like utilizing known means, preferably a simple flange bead on the seal releasably engaging within a peripheral groove about the rim area of the container. In providing for such a conventional mounting means for the seal to container, the seal is adaptable to substantially any of the more commercially available containers, requiring only that the seal be of a size to accommodate the rim area of a container. In most instances, and as shown in the illustrated embodiment, both the seal and container mouth will be circular.

The actual stacking ability arises from a unique configuration of the seal, and more particularly the upper face thereof, which enables a duplicate seal, when inverted and engaged with the first seal, to releasably snap lock thereto, thereby achieving a positive and desirable stacking of two containers, each provided with a separate seal. Such a stacking arrangement, in addition to the significant advantage of allowing for stacking without requiring a specific configuring of each container to the lid or seal, also provides all of the advantages of stacked containers, including provision for the carrying of two separate foodstuff containers as a single unit from a restaurant, on a picnic, for at work lunches, and the like. Such stackable containers also facilitate storage in any situation where space is limited or the stacking of containers is otherwise desirable, as in a refrigerator or the like.

In achieving the goals of the invention, the seal, in addition to including a generally conventional and rather universal means for mounting to a container, is provided, on the upper surface thereof, with means particularly configured for releasable interlocking with an inverted duplicate seal. More specifically, the seal will include multiple spaced upwardly projecting protuberances thereon with recesses defined between the protuberances. The recesses are generally complementary in size and shape to the protuberances whereby, upon engaging inverted duplicate seals, the protuberances of each seal will engage within the recesses of the other seal.

The side edges of adjoining protuberances in the overlaid seals will releasably interlock with each other, each side edge being defined with a locking lip and a receiving groove which receives the corresponding lip of the engaged seal.

In a preferred embodiment as illustrated in the drawings, the seal will be circular with the protuberances, preferably three, spaced equally thereabout and configured as truncated triangles with equally spaced recesses therebetween for accommodation of the protuberances of an overlying seal.

Preferably, an outwardly and downwardly extending finger tab will extend integrally from the periphery of the seal for use, with the finger tab on a duplicate inverted seal, both as a means for disengaging the seals without affecting the engagement of the individual seals with their associated containers, and as a means for aligning the overlaid seals for facilitating engagement of the protuberances and recesses.

Further features, objects and advantages of the invention will be noted as the construction and details of the invention are more fully hereinafter set forth.

DESCRIPTION OF PREFERRED EMBODIMENTS

Figure 1:
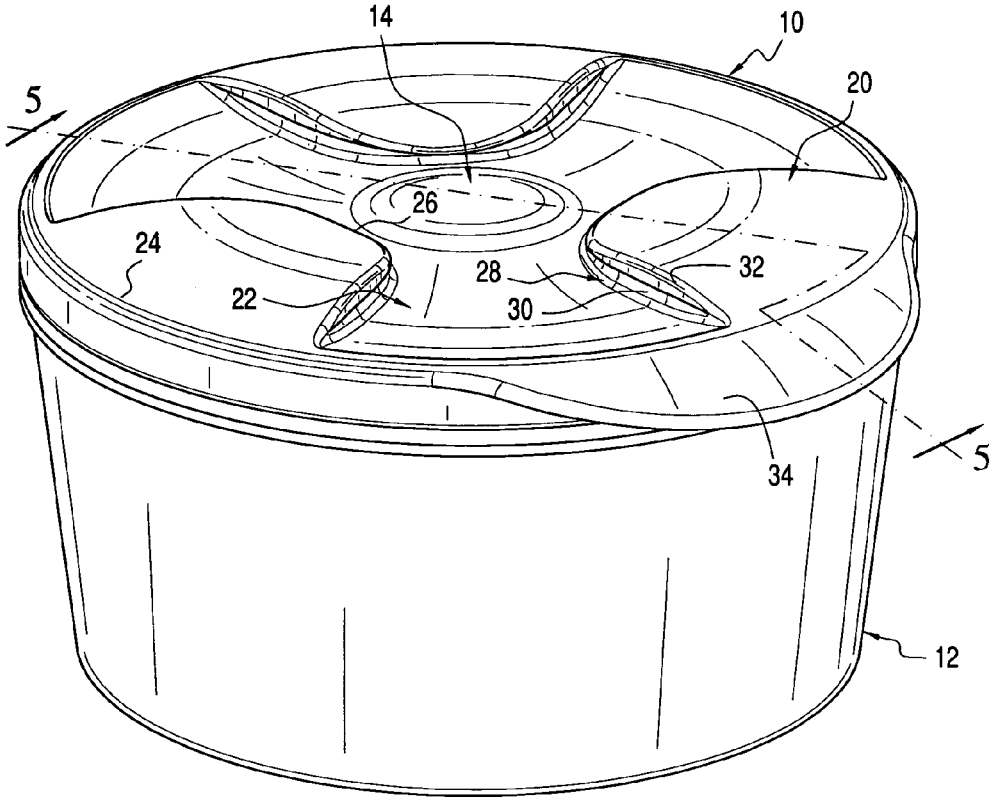
FIG. 1 is a perspective view of the seal of the invention mounted to a container as a closure therefor.
Figure 5:
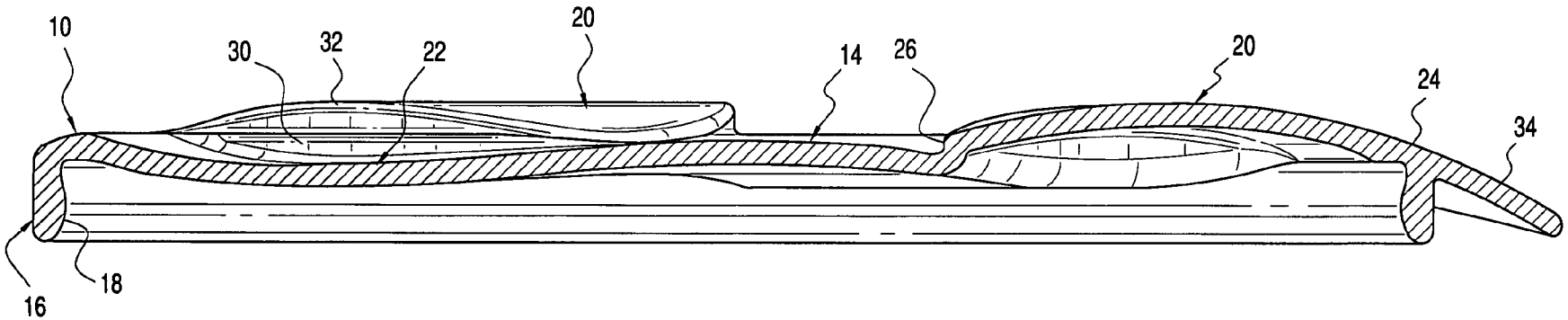
FIG. 5 is an enlarged cross-sectional detail taken substantially along line 5-5 in FIG. 1.

Referring now more specifically to the drawings, and noting in particular FIGS. 1 and 5, the seal 10 is adapted to mount to a conventional container 12 with the seal dimensioned to accommodate the container and define a removable closure therefor. It is contemplated that the seal interlock to the rim or rim portion of the container in any appropriate manner. As such, the base panel 14 of the seal 10, about the outer periphery thereof, can include an integral depending peripheral flange 16 formed with an inwardly directed annular bead 18 adapted to snap-engage within a corresponding annular groove about the container rim. The container and the particular manner in which the seal engages the container are conventional and the releasable engagement therebetween can be of any preferred design.

The uniqueness of the seal 10 resides in the manner and construction by which provision is made for interlocking the seal to a duplicate inverted seal for the releasable joining of two containers in an overlying seal-to-seal relationship. Pursuant thereto, the base panel 14 is provided with multiple upwardly extending projections or protuberances 20 on the upper face thereof with similarly configured recesses 22 therebetween whereby upon inverting of one seal 10 over another, the protuberances 20 of each seal will engage within the complementary recesses 22 of the other seal. The protuberances 22 will, in the joined seals, releasably lock to adjacent protuberances on the opposite seal to releasably maintain the stacked relationship between the containers, as shall be explained subsequently.

Noting FIG. 1 in particular, the protuberances 20 are preferably of a generally triangular configuration equally spaced about the container base panel 14 and converging inwardly from a base edge 24 at the seal periphery to an inner or apex end 26. The inner end 26 of each protuberance is preferably truncated, either planar or arcuate as illustrated, with these truncated inner ends 26 of the protuberances spaced outwardly from each other and the central area of the base panel 14. The upper or outer surface of each protuberance, as illustrated, is preferably convex between the base edge 24 and the apex 26 with the inwardly converging side edges 28 of each protuberance tapering from a maximum height generally centrally thereof to minimum height toward the protuberance base edge 24 and apex 26.

The protuberance receiving recesses 22, corresponding in number to the protuberances, are defined between the protuberances and, in addition to having a generally inwardly directed triangular configuration to conform to the shape of the protuberances, have a generally concave bottom surface, defined by the base panel 14, to accommodate the convex outer surface of a received protuberance 20.

While three protuberances 20 have been illustrated, it will be appreciated that any practical number of protuberances, with a corresponding number of complementary recesses, can be utilized.

Figure 6:
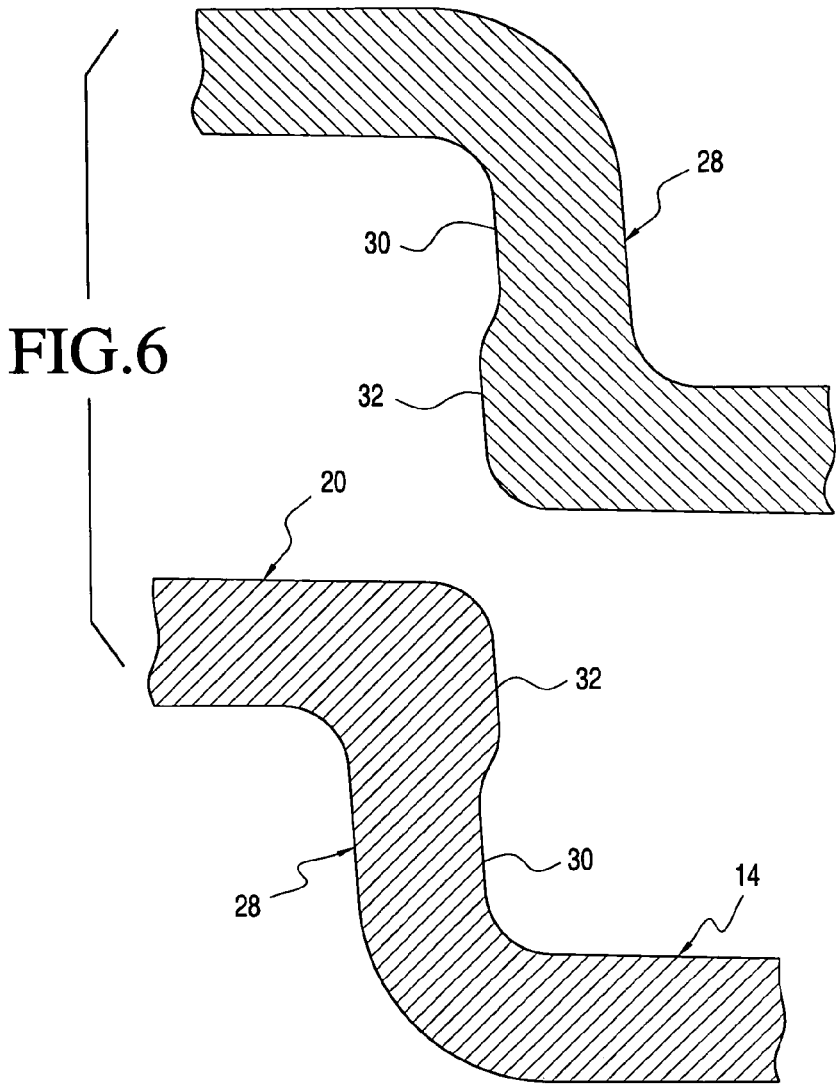
FIG. 6 is an enlarged exploded detail taken substantially on line 6-6 in FIG. 3 and illustrating the snap lock means between a seal and an inverted duplicate seal.
Figure 7:
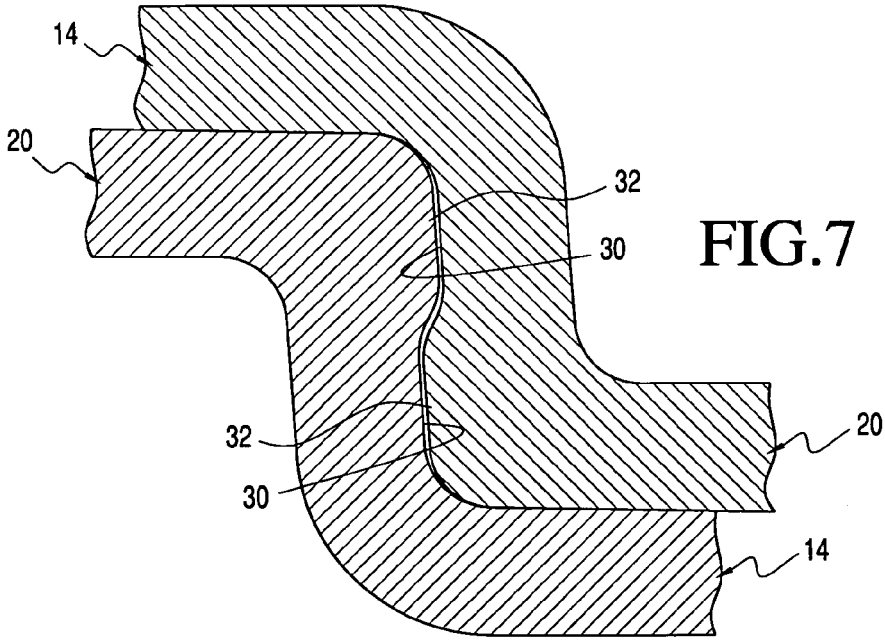
FIG. 7 is a cross-sectional detail taken substantially on a plane passing along line 7-7 in FIG. 2 and illustrating the interlock between the two seals.

In order to provide for the desired releasable snap-lock engagement of the seals, the upwardly extending side edges 28 of each protuberance 20 are undercut adjacent the base panel 14 to form a groove 30 which in turn defines an outer or upper bead or lip 32. Attention is particularly directed to FIGS. 6 and 7 for these details and FIG. 1 for an overall view of the formed groove which will vary in height, generally following the configuration of the convex upper surface of the protuberance. The desired snap interlock between overlying seals is effected by the beads 32 of each protuberance engaging within the grooves 30 of the adjacent oppositely directed protuberances as suggested in FIGS. 6 and 7. The grooves 30 preferably do not extend about or cross the apex ends 26 of the protuberances 20, the engagement between the seals only occurring along the inwardly converging side edges 28 of the protuberances.

Figure 2:
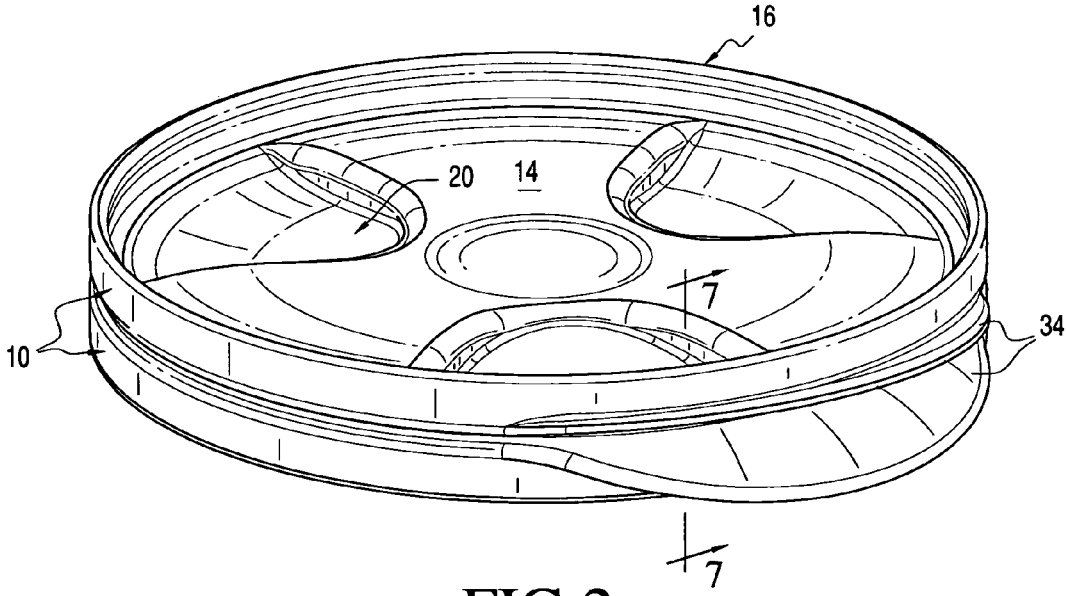
FIG. 2 is a perspective view of the seal of FIG. 1 with a second duplicate seal inverted and snap-locked to the first seal.

In order to facilitate removal of the seal 10 from a container 12, an integral outwardly projecting finger tab 34 can be provided extending from the periphery of the seal. The finger tab 34 will, preferably, arc downwardly and outwardly relative to the periphery of the seal 10. This is particularly significant in facilitating a disengagement of the inverted seals without disruption of the sealed relationship of the seal to the corresponding container. In this regard, note FIG. 2 in particular wherein the finger tabs, used as an alignment means for the engagement of the seals to each other, overlie each other and flare away from each other, allowing for a grasping of the individual finger tabs and a removal of the sealed containers from each other.

Figure 3:
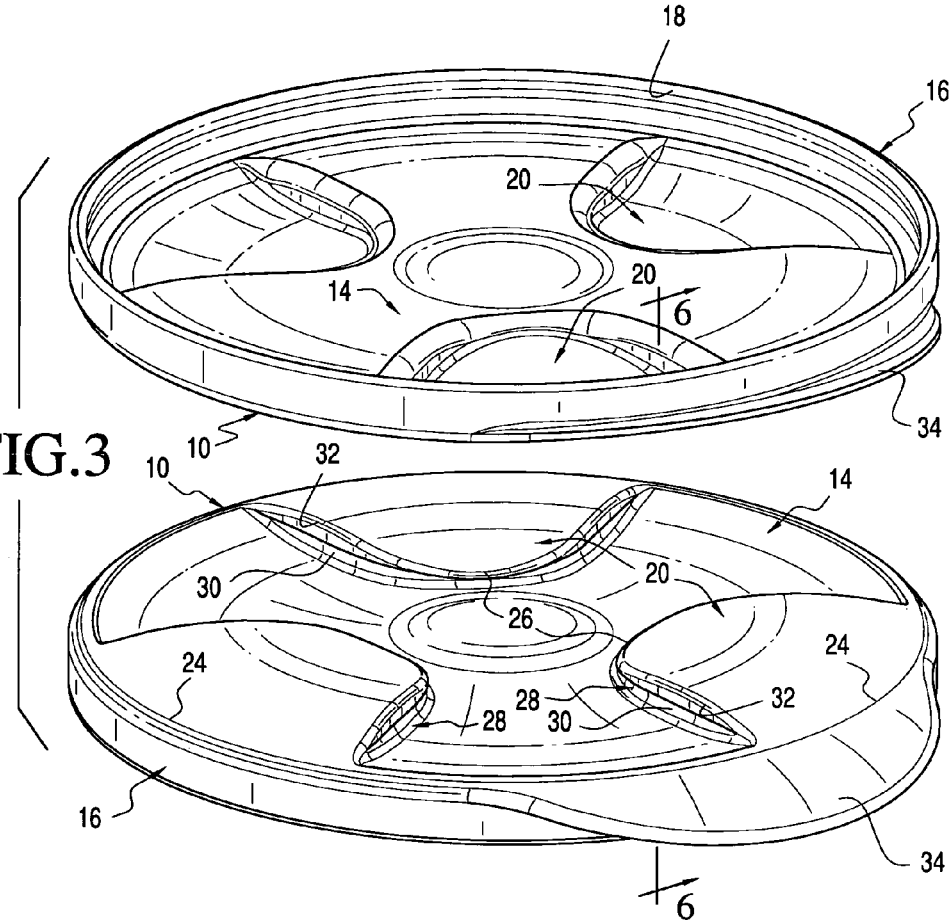
FIG. 3 is an exploded perspective view of the two seals of FIG. 2 aligned for engagement.
Figure 4:
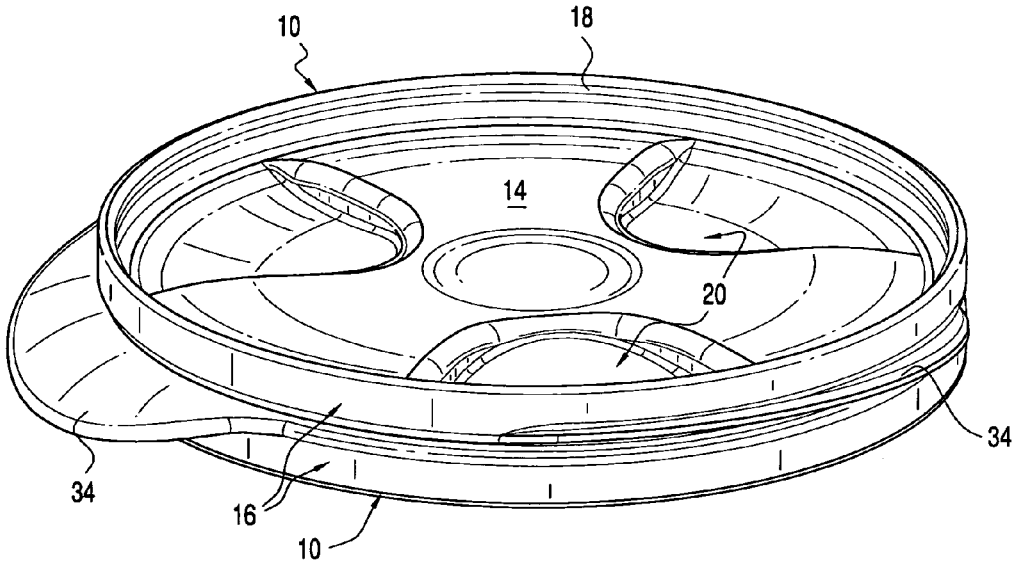
FIG. 4 is a perspective view of two interlocked seals illustrating an alternative rotational relationship therebetween wherein the finger tabs are not in alignment.

Noting FIGS. 1 and 3, the finger tab, which is of a peripheral length easily grasped by the fingers, is centrally aligned with one side edge 28 of a protuberance, extending equidistance peripherally about corresponding lengths of the base edges of an adjacent protuberance and recess. Thus, the finger tabs of overlying duplicate seals, upon alignment with each other, will automatically align the protuberances and recesses for engagement. It will also be appreciated, as suggested in FIG. 4, in those instances wherein the protuberances and recesses are symmetrically arranged about the seals, the lids can interlock in any of a plurality of rotated positions relative to each other. In other words, the finger tabs 34 need not be aligned, although the aligning of the finger tabs has particular advantages in both engaging and disengaging the seals.

The central alignment of the finger tab 34 with one of the grooved side edges 28 of a protuberance 20 is also desirable in that, in disengaging the seals 10 from each other, parting force is applied directly along one edge with the gradual parting along this edge slightly deflecting the upper seal and providing for a relatively smooth progressive disengagement of the remaining engaged edges. Similarly, the absence of engagement of the apex ends of the protuberances, while not affecting the positive desired releasable interlock between adjacent nested protuberances, also facilitates the smooth disengagement of the seals from each other without disruption of the seal and container relationship.

As will be recognized from the foregoing, the seal of the present invention uniquely functions as an imperforate seal providing not only a closure for a container, but also a means for stacking containers. The interlock between the container seals, provided by the seals themselves, cooperatively engages in a manner which interlocks the seals while at the same time allowing for simple manual release or disengagement with the closure relationship of the individual seal to its container maintained. It will be recognized that the seal of the invention allows for the desired stacking of containers regardless of the configuration of the container and without requiring any modification of the base of the container to cooperate with the seal. The seal also allows for a standard seal-to-container relationship in accommodating the seal to a conventional container.

The foregoing is illustrative of the principles of the invention. While a specific embodiment or embodiments have been illustrated and described, other embodiments as encompassed within the scope of the appended claims will occur to those skilled in the art and are deemed to fall within the scope of the invention.

The invention claimed is:

1. A seal removably mountable to the rim of an open container as a closure for said container, said seal comprising a base panel having an outer periphery with means for releasably engaging the seal to a container, said base panel having an upper face and a lower face, multiple upwardly directed protuberances on said upper face, said protuberances being spaced from each other and defining recesses therebetween, each recess being of a configuration substantially conforming to a protuberance on said lower face, whereby a second seal with duplicate protuberances and recesses will, when inverted and engaged with the first mentioned seal, engage the protuberances and recesses of said first seal, and wherein said seal further comprises means on each protuberance laterally directed toward adjacent recesses for releasable engagement with a recess received protuberance of a duplicate inverted seal.

2. The seal of claim 1 wherein the protuberances are peripherally spaced about the outer periphery of the base panel and converge inwardly from and relative to the outer periphery, said protuberances terminating at inner ends spaced from each other centrally of said base panel.

3. The seal of claim 2 wherein each protuberance is of a generally triangular configuration with a base edge at said outer periphery and an inner apex at the inner end of the protuberance.

4. The seal of claim 3 wherein each protuberance has an outer surface upwardly convex and arcing from said base edge to said apex, each said protuberance being of a maximum height between said base edge and said apex, each said recess being concave and complimenting the convex outer surface of a protuberance.

5. The seal of claim 4 wherein each protuberance has opposed side edges converging from said base edge to said apex, said means on each protuberance for releasable engagement comprising an undercut portion between the base edge and the apex, said undercut portion defining a groove with a locking lip upward of said groove, whereby each groove is adapted to receive a locking lip of an inverted duplicate seal upon engagement of the seals with the protuberances of each seal received within the complementary recesses of the other seal.

6. The seal of claim 5 wherein each protuberance side edge undercut portion is of a maximum height at a central portion along the side edge.

7. The seal of claim 6 wherein each undercut portion terminates short of the corresponding apex.

8. The seal of claim 7 wherein each apex is truncated.

9. The seal of claim 8 including a finger tab fixed to and projecting outwardly from said outer periphery of said base panel.

10. The seal of claim 9 wherein said tab extends generally at an angle downwardly relative to said base panel.

11. The seal of claim 10 wherein said tab, as an alignment means for overlying seals, aligns with one of said protuberance side edges.

12. The seal of claim 9 wherein said tab, as an alignment means for overlying seals, aligns with one of said protuberance side edges.

13. The seal of claim 3 wherein each protuberance has opposed side edges converging from said base edge to said apex, said means on each protuberance for releasable engagement comprising an undercut portion between the base edge and the apex, said undercut portion defining a groove with a locking lip upward of said groove, whereby each groove is adapted to receive a locking lip of an inverted duplicate seal upon engagement of the seals with the protuberances of each seal received within the complementary recesses of the other seal.

14. The seal of claim 1 wherein each protuberance has opposed side edges, said means on each protuberance for releasable engagement comprising a groove with an overlying locking bead, whereby each groove is adapted to receive a locking bead of an inverted duplicate seal upon engagement of the seals with the protuberances of each seal received within the complementary recesses of the other seal.

15. A seal removably mountable to the rim of an open container as a closure for said container, said seal comprising a base panel having an outer periphery, and upper face, and a lower face, said base panel having multiple upwardly directed protuberances on said upper face, said protuberances being spaced from each other and defining recesses therebetween, said recesses being configured to substantially conform to each protuberance on said upper face, wherein each protuberance is of a generally triangular configuration with a base edge at said outer periphery and apex at the inner end of the protuberance, and opposed side edges converging from said base edge to said apex.

16. The seal of claim 15 wherein each side edge, along a major portion of the length thereof between said base edge and said apex is undercut and defines an elongate groove therein with a bead defined outward of and along said groove.

17. The seal of claim 16 including a finger tab fixed to and projecting outwardly from the outer periphery of said base panel, said tab extending generally at an angle inclined outward and downward relative to said base panel.

* * * * *